US005447486A

United States Patent [19]

Anderson et al.

[11] Patent Number: 5,447,486

[45] Date of Patent: Sep. 5, 1995

[54] MAINTAINING PERFORATION PHASING

[75] Inventors: Danford C. Anderson, Green Bay; Peter J. Hatchell, New Franken, both of Wis.; Emiel Lambrecht, Aalst; Eric DeSmedt, Opwijk, both of Belgium

[73] Assignee: FMC Corporation, Chicago, Ill.

[21] Appl. No.: 151,439

[22] Filed: Nov. 12, 1993

Related U.S. Application Data

[63] Continuation-in-part of Ser. No. 23,992, Feb. 26, 1993, Pat. No. 5,292,299, which is a continuation-in-part of Ser. No. 981,967, Nov. 25, 1992, abandoned.

[51] Int. Cl.[6] ..... B31B 1/64; B31B 19/00

[52] U.S. Cl. ..... 493/11; 493/15; 493/197

[58] Field of Search ..... 493/11, 13–15, 493/17, 18, 22, 34, 24, 197, 238

[56] References Cited

U.S. PATENT DOCUMENTS

| | | |
|---|---|---|
| 4,695,346 | 9/1987 | Lehmacher . |
| 4,847,775 | 7/1989 | Bobst . |
| 4,934,993 | 6/1990 | Gietman, Jr. . |
| 5,094,656 | 3/1992 | Hatchel et al. . |

FOREIGN PATENT DOCUMENTS

| | | |
|---|---|---|
| 0545057 | 6/1993 | European Pat. Off. . |
| A2030599 | 1/1972 | Germany . |
| A3230816 | 2/1984 | Germany . |
| 1493245 | 11/1970 | United Kingdom . |
| 2039096 | 7/1980 | United Kingdom . |
| 2088100 | 6/1982 | United Kingdom . |

*Primary Examiner*—Jack W. Lavinder
*Attorney, Agent, or Firm*—Henry C. Query, Jr.

[57] ABSTRACT

In an apparatus for making plastic bags or the like from a continuous film of material comprising a sealing drum having at least one seal bar for imparting transverse seals to the film at regularly spaced intervals and a perforator having a rotatable perforator blade for imparting transverse perforations to the film at regularly spaced intervals, the film comprising print marks appearing thereon at regularly spaced intervals, an apparatus and method are disclosed for tracking the positions of each print mark and each perforation and comparing the difference between these positions to a desired difference and thereafter adjusting the angular position of the perforator blade until the difference between the positions of each print mark and each perforation is equal to the desired difference to thereby maintain a desired spacing between each print mark and each perforation.

3 Claims, 5 Drawing Sheets

MAINTAINING PERFORATION PHASING

This application is a continuation-in-part application Ser. No. 08/023,992 filed on Feb. 26, 1993; now U.S. Pat. No. 5,292,299 which is a continuation-in-part of application Ser. No. 07/981,967 filed on Nov. 25, 1992now abandoned.

BACKGROUND OF THE INVENTION

1. Field of the Invention

This invention relates to machines for making plastic bags or the like from a continuous web of material and, more specifically, to machines comprising a radially adjustable sealing drum and means for adjusting the sealing drum to maintain a desired spacing between the seals imparted to the web by the sealing drum and any registration mark appearing on the web. More particularly, the invention relates to a machine which further comprises means for perforating the web to enable individual bags to be subsequently separated from the film and means for automatically maintaining a desired spacing between the seals and the perforations.

2. Description Of Related Art

In existing bag making machines, a continuous film is drawn from a source, such as a roll of plastic tubing, and is fed into a sealing drum and blanket assembly where transverse seals are impaled to the film to define individual plastic bags. The film then travels through various optional stations, such as a handle punching station and a folding board assembly, where further operations are performed on the film. Finally, the film is conveyed through a perforator, which perforates the film transversely of the direction of travel so that the individual bags can be subsequently separated from the film. The perforations are placed adjacent the seals and, to avoid wasting material, the distance between the perforation and the seal, which is referred to as the "skirt", should be kept at a desired minimum. Also, in twin seal bags, which are open transverse to the direction of travel and have a seal defining each side, the perforation is located between the seals defining adjacent sides of consecutive bags. In order to avoid wasting material in the production of this type of bag, the adjacent seals should be located a minimum distance apart and, therefore, care must be taken to consistently locate the perforation between the seals.

In many applications it is desired that printed matter appear on the individual bags. In these instances, the source of the film may comprise a continuous roll of tubing having preprinted matter imparted thereon at spaced intervals corresponding to the desired size of the bags. Furthermore, it is typically required that the printed matter appear at the same location on the individual bags from bag to bag. This requirement is usually addressed by maintaining a fixed distance from the printed matter to the seal on each bag. However, since the locations of the preprinted matter on the tubing may vary due to certain factors in the production and printing of the tubing, it is often difficult to maintain a fixed distance between the seal and the printed matter.

Apparatus for automatically varying the placement of the location of the seals to maintain a fixed distance between the seals and the printed matter is disclosed in U.S. Pat. No. 4,934,993, issued to Gietman, Jr. In Gietman, Jr., the film contacting surface of the sealing drum comprises a number of slats and one or more seal bars. The diameter of the drum is variable in response to a motor located within the drum which is connected through a series of gears and chains to a number of threaded rods supporting the ends of the slats and seal bars. A first detector detects a registration mark appearing on the film at regular intervals in spaced relation to the printed matter and a second detector generates a signal representative of one revolution of the sealing drum. A CPU then compares the relationship between these signals with certain preset conditions and, if necessary, activates the sealing drum motor to vary the diameter of the sealing drum and thereby change the relationship between the seals and the printed matter until a desired constant is arrived at and maintained.

However, in Gietman, Jr. and other prior art bag making machines, the perforator is driven by the sealing drum and the location of the perforation relative to the seal is dependent upon the diameter of the sealing drum. Thus, while the distance between the seal and the perforation can be initially manually set, automatically varying the diameter of the sealing drum to maintain a desired relationship between the seal and the printed matter will consequently alter the distance between the seal and the perforation. In prior art bag making machines, the operator is required to manually adjust the perforator to maintain the proper distance between the seals and the perforations if any changes have occurred. For example, Gietman, Jr. discloses using a hand-operable variator to do this. However, since automatically adjusting the location of the seals in relation to the printed matter can result in repeated changes in the location of the seals, manually adjusting the perforator is not practical. To compensate for not having to continually adjust the perforator, the distance between the perforations and the seals is typically selected to be large enough to accommodate certain variations in the location of the seals. However, given the large volume of bags usually produced in a given production run, these large skirt sizes result in a great deal of material waste.

SUMMARY OF THE INVENTION

Therefore, it is an object of the present invention to provide a means to automatically adjust the perforator in response to changes in the diameter of the sealing drum to maintain a constant minimum distance between the perforations and the seals regardless of changes in the location of the seals and variations in the speed of the machine.

According to the present invention, these and other objects and advantages are achieved by providing a bag making machine with means for digitally controlling the angular position of the perforator in response to a signal representative of the difference between the positions of the sealing drum and the perforator blade. This is accomplished by providing means for generating a signal representative of the position of the sealing drum, means for generating a signal representative of the position of the perforator blade, means for comparing the difference between these position signals with an operator invoked value representative of the desired difference between the seals and the perforations, and means for automatically adjusting the rate of rotation of the perforator to change the angular position of the perforator blade so that the difference between the position signals equals the desired difference. The means for providing the position signals are preferably electrical proximity switches: one for tracking each revolution of the sealing drum and another for tracking each rotation of the perforator blade. The means for adjusting the angular position of the perforator blade includes a synchronous motor operating in conjunction with a differential mounted between the perforator drive pulley and the perforator shaft. An encoder connected to the output shaft of the main drive motor provides a continuous pulse train against which the sealing drum switch signals and the perforator switch signals may be referenced. A CPU registers the number of pulses generated by the encoder between each drum switch signal and the next perforator switch signal. During the initial test stages of the production run, the operator will determine if the distance between each seal and the adjacent perforation is what is desired. If not, the operator will input an appropriate command into the CPU and the CPU will activate the synchronous motor to either increase or decrease the rate of rotation of the perforator to change the angular position of the perforator blade until the perforations are the desired distance from the seals. At this point, the CPU registers the number of pulses between signals generated by the drum and perforator switches as the desired number of pulses. Thereafter, the CPU will continue to monitor the number of pulses actually being generated between signals from the drum and perforator switches and compare these values to the desired number of pulses. If the two values are not equal, the CPU will activate the synchronous motor to increase or decrease the rate of rotation of the perforator to thereby change the angular position of the perforator blade until the number of pulses actually generated is once again equal to the desired number of pulses. In this manner, the bag making machine of the present invention effectively tracks the spacing between the seals and the perforations and automatically adjusts the perforator, if necessary, to maintain the spacing at a desired minimum value.

In another embodiment of the invention, the angular position of the perforator blade is controlled in response to a signal representative of the difference between the position of a registration mark applied to the film and the position of the perforator blade. This is accomplished by providing a means for generating a signal representative of the position of the registration mark, which, when the registration mark is a print mark, can be a photo scanner. In this embodiment, the CPU registers the number of pulses generated by the encoder between each photo scanner signal and the next perforator switch signal. The operation thereafter proceeds as described above, with the CPU activating the synchronous motor to change the angular position of the perforator blade until the number of pulses actually generated between the photo scanner signal and the perforator switch signal is equal to a desired number of pulses. With the seals being held in register to the registration marks, maintaining a certain spacing between the perforations and the registration marks provides a way to, in effect, maintain a desired spacing between the perforations and the seals, which is the desired result.

In yet another embodiment of the present invention, the perforator is driven by a servo motor, the position and velocity of which are controlled by the CPU based on outputs from an encoder coupled to the shaft of the sealing drum. The angular position of the servo motor and, therefore, the perforator blade is adjusted by the CPU in response to an error signal. The error signal is the difference between the number of pulses generated between signals from the perforator switch and the registration mark detector and the number of pulses relating to the actual distance between the perforator switch and the registration mark detector. The seal bars are adapted to place a registration mark on the film at a fixed location proximate the seals. In this manner, the CPU can adjust the servo motor to position the perforator blade at the registration mark for each bag passing through the machine.

These and other objects and advantages of the present invention will be made apparent from the following detailed description, with reference to the accompanying drawings.

Detailed Description of the Preferred Embodiments

Figure 1:
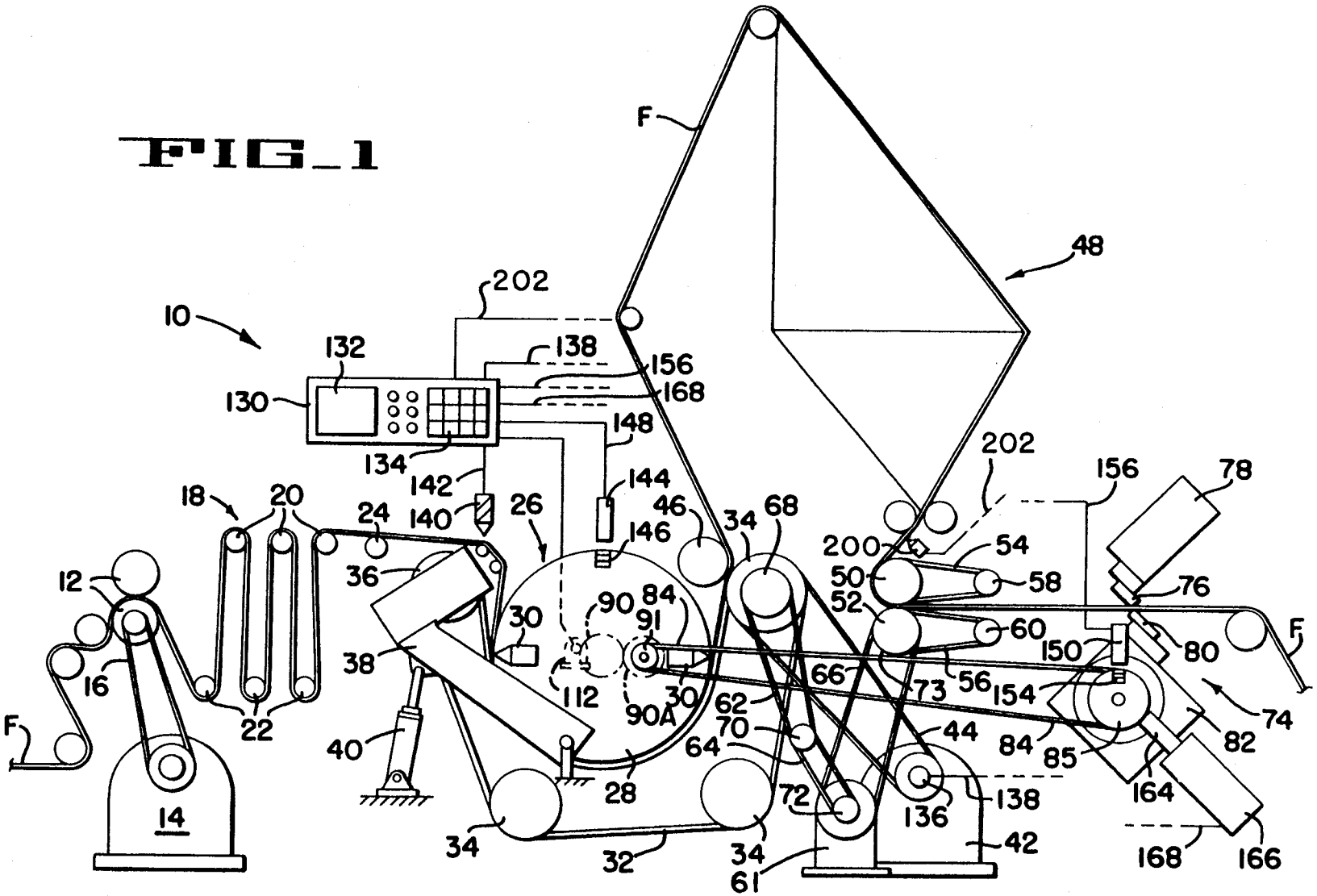
FIG. 1 is a schematic representation of a bag making machine incorporating the present invention.

Referring to FIG. 1, a bag making machine incorporating the present invention is identified generally by numeral 10 and comprises certain conventional components which will be described briefly before a more detailed description of the present invention is undertaken. A continuous film of material F is drawn into bag machine 10 by a pair of infeed nip rolls 12 which are driven by a motor 14 through a belt 16. Film F can be comprised of plastic or any suitable material from which bags or the like are typically manufactured and is supplied to bag machine 10 by any conventional source, such as a large roll or an extruder, in either sheet or flat tubular form, depending on the type of bag desired to be manufactured. In addition, film F can be supplied with preprinted matter appearing thereon at regularly spaced intervals corresponding to the size of the individual bags to be produced. After passing through rolls 12, film F passes through an idler and dancer roll assembly 18 comprising idler rolls 20 and dancer rolls 22. The idler and dancer roll assembly 18 controls the tension and speed of film F in a manner known in the art. After exiting idler and dancer roll assembly 18, film F is drawn over a guide roll 24 and into a sealing drum and blanket assembly 26, where transverse heat seals are applied to film F to define individual bags. As will be described more fully hereinafter, the sealing drum 28 comprises one or more seal bars 30 which are selectively activated depending on the desired length of the bags being produced. Furthermore, the diameter of sealing drum 28 is adjustable between minimum and maximum limits to increase the range of possible bag lengths and to allow the seals to be imparted to film F at a desired fixed distance from any preprinted matter appearing on film F, as will be described. Sealing blanket 32 is constructed of silicone coated nylon, or any other suitable heat resistant material, and is mounted upon a number of fixed blanket rolls 34 rotationally connected to the frame of bag machine 10 and at least one blanket roll 36 supported in an arm 38 which, through operation of piston 40, is pivotable to maintain sealing blanket 32 taut against sealing drum 28 regardless of the diameter of sealing drum 28. Sealing blanket 32 is driven by a main drive motor 42 through a drive belt 44 which is entrained around one of the fixed blanket rolls 34. The contact force between sealing blanket 32 and sealing drum 28 in turn causes sealing blanket 32 to drive sealing drum 28 and thereby draw film F through sealing drum and blanket assembly 26. As is known in the art, the speed of main drive motor 42 and the speed of motor 14 are interdependent so that the flow of film F will not be interrupted. After passing through sealing drum and blanket assembly 26, film F passes over a chill roll 46, which functions to cool the heat seals. Thereafter, film F may be directed, if desired, into a folding board assembly 48, where film F is folded widthwise one or more times depending on the parameters of the desired end product. Film F is then drawn between nip rolls 50 and 52 and is conveyed along between guide cords 54 and 56, which are entrained around rolls 50 and 58 and rolls 52 and 60, respectively. Nip roll 52 is driven by a variable speed device 61, which is driven indirectly by motor 42 through the driven fixed blanket roll 34 and a series of intermediate belts 62, 64 and 66 mounted upon pulleys 68, 70, 72 and 73. Nip rolls 50 and 52 and guide cords 54 and 56 convey film F toward a perforator 74, where transverse perforations are applied to film F so that individual bags can be subsequently separated from each other. Perforator 74 comprises an upper cutting bar 76 attached to a fixed upper block 78 and a lower cutting bar or blade 80 attached to a rotatable lower block 82. Lower perforator block 82 and, consequently, perforator blade 80 are driven by sealing drum 28 through a belt 84 entrained around a perforator drive pulley 85, which is mounted on the input shaft of a differential connected to perforator block 82, as will be described. Therefore, perforator 74 and sealing drum 28 are normally in phase.

Figure 2:
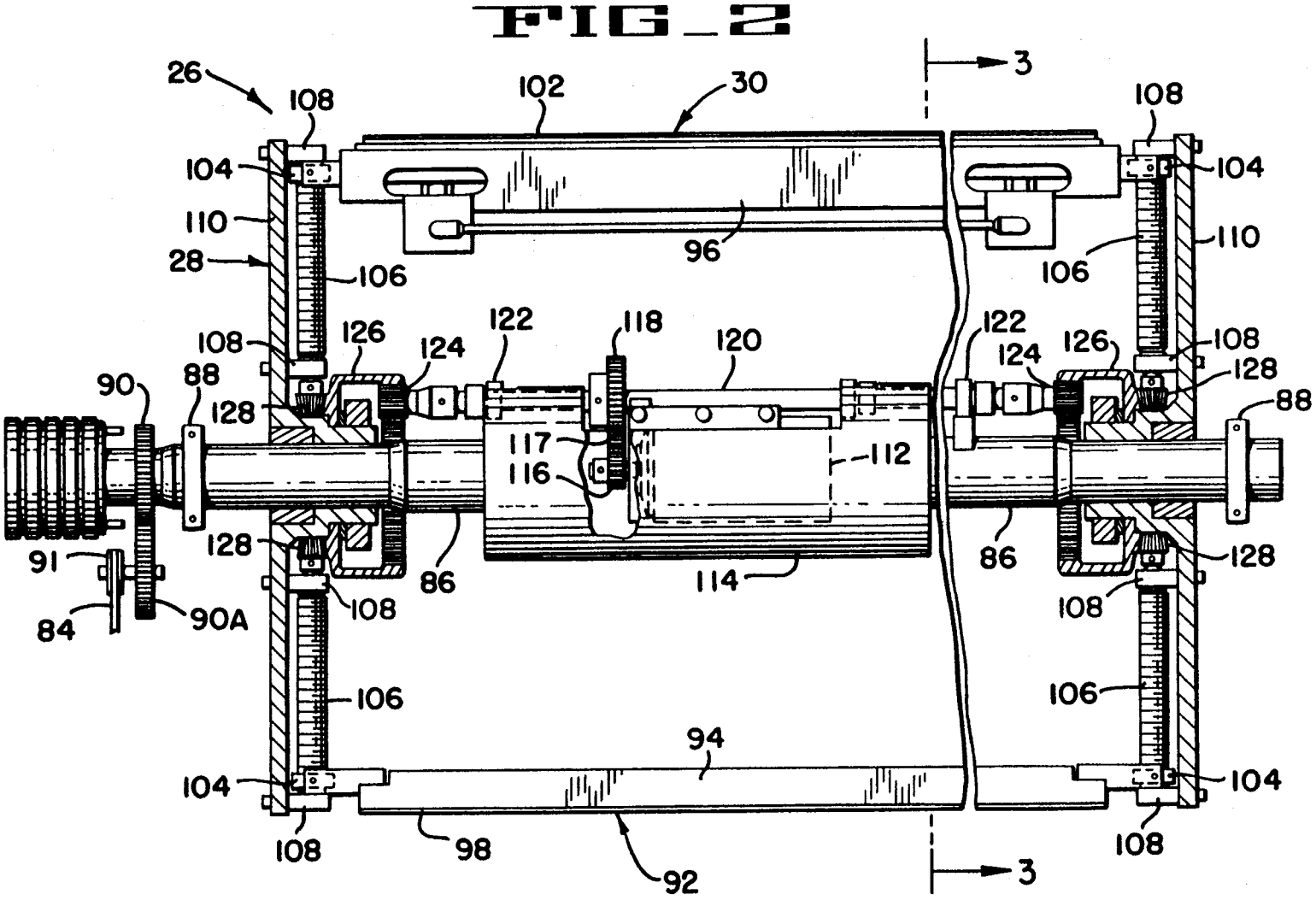
FIG. 2 is a front elevation view of the sealing drum employed in the present invention.
Figure 3:
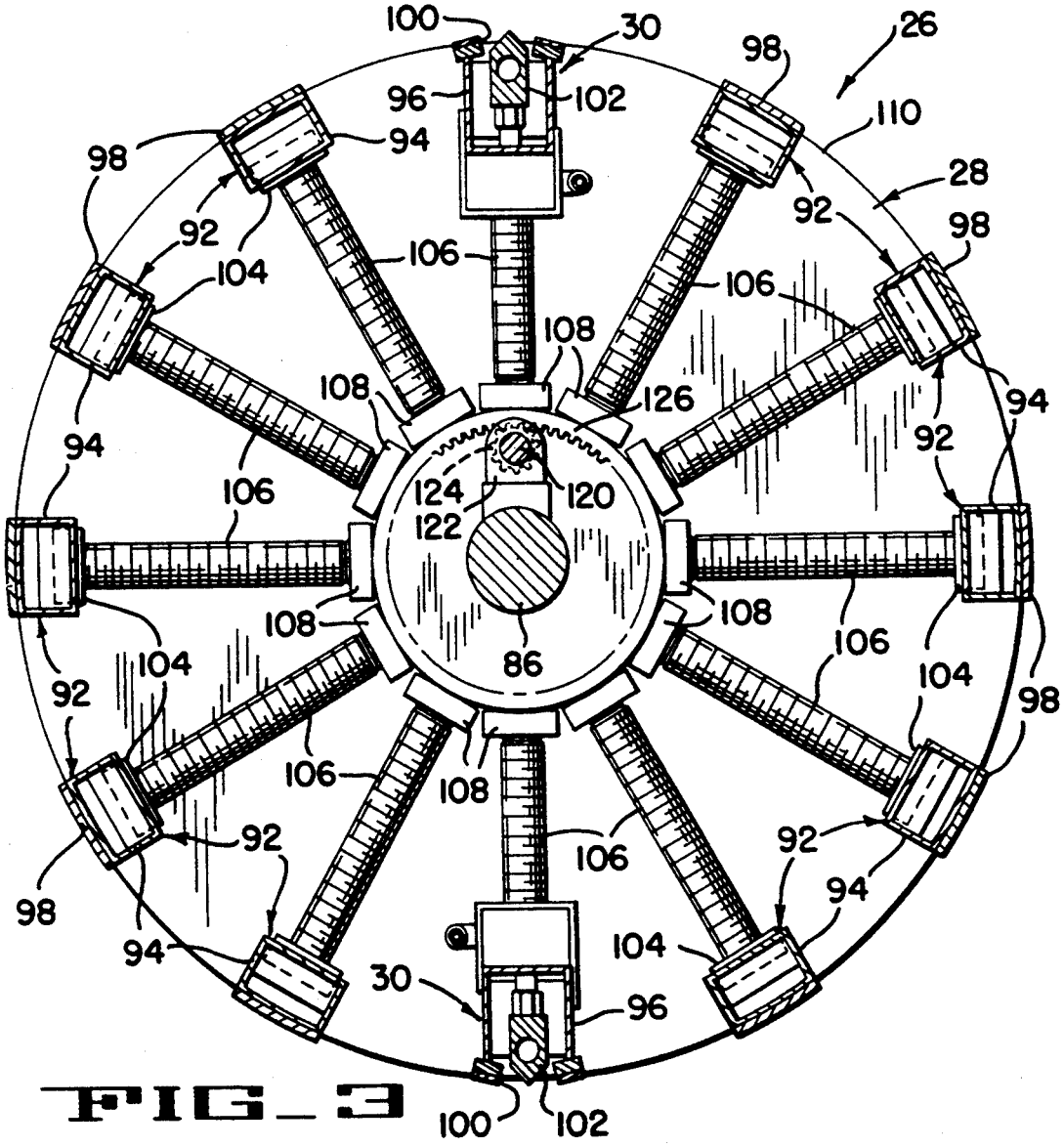
FIG. 3 is a cross-sectional view of the sealing drum taken along line 3—3 of FIG. 2.

As previously discussed, the diameter of sealing drum 28 is adjustable to vary the locations of seal bars 30 with respect to film F so that bags of several lengths may be produced and the seals imparted onto film F can be maintained in a fixed relationship with respect to printed matter appearing on film F. Although the diameter of sealing drum 28 is typically initially set so that seal bars 30 are in phase with the printed matter appearing on film F, variances in the printing of film F and other factors can cause the seals to become out of phase with the printed matter. In order to alleviate this problem, sealing drum 28 is automatically adjustable to bring the seal bars 30 back in phase with the printed matter. Referring to Figures 2 and 3, sealing drum 28 is mounted on a shaft 86 which is rotatably supported within bearing assemblies 88 connected to the frame of bag machine 10. A gear 90 attached to the end of shaft 86 drives a gear 90A which in turn drives a timing belt pulley 91, which receives belt 84 through which perforator 74 is driven. The surface of sealing drum 28 is comprised of a number of spaced apart slats 92 and seal bars 30. Slats 92 and seal bars 30 are comprised of rigid rectangular sections 94 and 96, respectively, extending longitudinally substantially the width of sealing drum 28. The outer surface 98 of each slat 92 is slightly curved and is overlaid with an appropriate rubber-type material to increase the frictional force between film F and sealing drum 28. Each seal bar 30 also comprises an outer surface overlaid with an appropriate rubber-type material, but in addition comprises a longitudinal opening 100 in the outer surface through which a heating element 102 protrudes. Each heating element 102 extends the length of seal bar 30 and is selectively activated depending on the desired length of the bags being produced to impart a transverse seal onto film F as film F passes between seal bar 30 and sealing blanket 32. The ends of slats 92 and seal bars 30 comprise threaded collars 104 which threadedly engage corresponding threaded rods 106. Threaded rods 106 are rotatably supported at each end within yokes 108 secured to the sidewalls 110 of sealing drum 28. The adjustability of the diameter of sealing drum 28 is provided through rotation of threaded rods 106, which is accomplished through the selective activation of a bi-directional motor 112 mounted within an enlarged diameter portion 114 of shaft 86 within sealing drum 28. The output shaft of motor 112 is connected through gears 116 and 117 to a gear 118, which is attached to a shaft 120 rotatably mounted within several bearing assemblies 122 connected to shaft 86. A pinion gear 124 mounted to each end of shaft 120 engages the inner teeth of a driven dish gear 126, the outer teeth of which engage bevel gears 128 attached to the inner ends of threaded rods 106. Thus, activation of motor 112 rotates shaft 120, which in turn rotates threaded rods 106 via gears 124, 126 and 128. Since collars 104 threadedly engage rods 106, rotation of rods 106 will in turn cause slats 92 and seal bars 30 to move away from or toward shaft 86, depending on the direction of rotation of motor 112. Furthermore, since the gearing arrangement connecting shaft 120 to rods 106 is identical for both sides of sealing drum 28, and since each dish gear 126 uniformly engages all the threaded rods associated with the corresponding side of sealing drum 28, the ends of slats 92 and seal bars 30 will advance simultaneously, thus maintaining slats 92 and seal bars 30 parallel to shaft 86 at all times.

Referring again to FIG. 1, the bag making machine of the present invention also comprises a central processing unit, or CPU, housed within a console 130. Console 130 comprises a display means 132, such as a CRT, and a data entry means 134, such as a keypad. The CPU is connected to display 132 and keypad 134 and controls the various operations of bag machine 10, as will hereafter be described. Keypad 134 is used by an operator to input various data and operating parameters pertaining to a particular production run, and display 132 is used to display this data and various operating conditions during the production run. Console 130 may also comprise a memory means connected to the CPU which contains prestored information relating to past or standard production runs.

Bag machine 10 comprises a number of devices which generate signals from which the CPU can control the operation of bag machine 10. A positional reference signal generating means 136, such as a resolver or an encoder, is mounted to the output shaft of motor 42 and is connected with the CPU through a line 138. Encoder 136 provides a digital pulse train representing discrete values of displacement of film F. As will be made apparent from the following description, this pulse train provides a basis with respect to which other signals are referenced. A registration mark detector 140 located upstream of sealing drum and blanket assembly 26 scans film F and signals the CPU via a line 142 when it detects a registration mark on film F. The registration mark can be a notch or hole formed in film F or a print mark applied to film F. the print mark can be a specific mark preprinted on film F at regular intervals corresponding to the desired length of the bags to be produced, or a specific portion of preprinted matter likewise appearing regularly on film F. Furthermore, when the registration mark is a notch or hole, registration mark detector 140 can be a spark gap detector or any similar means for detecting the notch or hole. Preferably, though, the registration mark is a print mark, and registration mark detector 140 is a photo scanner or any photo eye-type device which generates a signal in response to a predetermined frequency of reflected or transmitted light. A drum proximity switch 144 is mounted above sealing drum 28 and operates in association with a drum flag 146 mounted on the circumference of sealing drum 28 to signal the CPU via line 148 for each revolution of sealing drum 28. Drum proximity switch 144 can be a standard electrical proximity switch which is activated whenever drum flag 146, which is typically a metal object, passes in close proximity to it. A similar proximity switch 150 is located above the shaft 152 of rotatable lower block 82 of perforator 74 and operates in association with a perforator flag 154 mounted on shaft 152 to signal the CPU, via a line 156, for each revolution of lower cutting bar 80 of perforator 74.

Figure 4:
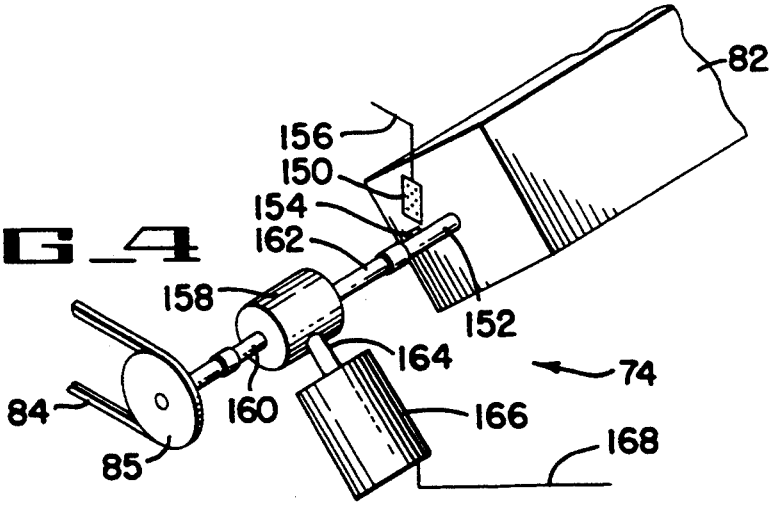
FIG. 4 is a schematic perspective partial view of the perforator of the present invention.

Referring to FIG. 4, in accordance with the present invention bag making machine 10 also comprises a differential 158 having an input shaft 160 upon which perforator drive pulley 85 is mounted and an output shaft 162 coupled to shaft 152 of lower perforator block 82. An output shaft 164 of a synchronous motor 166 engages differential 158 between input shaft 160 and output shaft 162 in a known manner to vary the rotation of output shaft 162 relative to input shaft 160 when activated. A stepper motor or a servo motor could be used in place of synchronous motor 166. Under normal operation, output shaft 162 rotates at the same rate as input shaft 160. However, when motor 166 is activated, output shaft 162 will rotate faster or slower than input shaft 160 depending on the direction of rotation of output shaft 164 of synchronous motor 166. A lead 168 electrically connects motor 166 with the CPU to enable the CPU to control the activation and direction of rotation of motor 166, as will be discussed.

During operation of bag machine 10, encoder 136 generates a continuous pulse train against which readings relating to the distance between registration marks on film F, the position of sealing bars 30 and the position of cutting bar 80 of perforator 74 are taken by the CPU. The CPU then compares these readings against parameters entered by the operator and generates control signals to sealing drum motor 112 and synchronous motor 166 to automatically adjust the spacing between the printed matter and the seals and the spacing between the seals and the perforations.

Typically, each occurrence of printed matter appearing on film F must appear on individual bags. Consequently, since the registration marks provide a means of tracking the location of the printed matter, the spacing between successive registration marks must be equal to the spacing between successive seals. The CPU initially determines the distance between successive registration marks and the distance between successive seals and, if necessary, adjusts sealing drum 28 to ensure that these distances are equal. As film F travels through bag machine 10, registration mark detector 140 generates a signal each time a registration mark passes beneath it. The signal generated by registration mark detector 140 flags the CPU to begin counting the pulses being generated by encoder 136. By thus tracking the number of pulses between signals generated by registration mark detector 140, the CPU can determine the phase or spacing of the printed matter appearing on film F. At the same time, drum proximity switch 144 signals the CPU each time drum flag 146 passes beneath it. The CPU registers the number of pulses between successive signals generated by switch 144 and thereby determines the circumference of sealing drum 28. Depending on the number of seal bars 30 being employed, therefore, the CPU can determine the relative positions of seal bars 30 and, therefore, the distance between the seals imparted onto film F. For example, if only one seal bar 30 is activated, then the number of pulses between signals from switch 144 corresponds to the distance between the seals. However, if multiple seal bars 30 are activated, then the distance between the seals corresponds to the number of pulses divided by the number of activated seal bars 30. The number of activated seal bars is automatically determined by the CPU according to the desired length of the bags to be produced, which is entered into the CPU by the operator. The CPU then compares the number of pulses generated by encoder 136 between signals from registration mark detector 140 and compares this number with the number of pulses corresponding to the distance between activated seal bars 30. If these two numbers are different, then the CPU will activate sealing drum motor 112 to adjust the diameter of sealing drum 28 in the manner previously described until the number of pulses between registration marks equals the number of pulses between activated seal bars 30. For example, if the distance between activated seal bars 30 is less than the distance between the registration marks appearing on film F, then the CPU will activate motor 112 to rotate in the direction required to increase the diameter of sealing drum 28. If, however, the distance between activated seal bars 30 is greater than the distance between the registration marks, the CPU will activate motor 112 to rotate in the direction required to decrease the diameter of sealing drum 28.

Once the distance between registration marks is equal to the distance between seals, the operator of bag machine 10 will observe the distance between each registration mark and the adjacent seal on the bags being produced. If the spacing is greater or less than what is desired, the operator will enter a value into the CPU corresponding to the difference between the actual distance between the registration mark and the adjacent seal and the desired distance between the registration mark and the adjacent seal. The CPU will then activate motor 112 to either increase or decrease the diameter of sealing drum 28 by a specific amount so that after a predetermined number of revolutions of sealing drum 28, the distance between each registration mark and the adjacent seal will be the desired distance. Thereafter, the CPU will activate motor 112 to return sealing drum 28 to the previous diameter at which the distance between successive seals was equal to the distance between successive registration marks. In this position, the registration marks are in phase with the seals, that is, the actual distance between each registration mark and an adjacent seal is equal to the desired distance. Once the registration marks are in phase with the seals, the CPU will register and continue to track the number of pulses generated by encoder 136 between the signals generated in turn by registration mark detector 140 and drum proximity switch 144. If the number of such pulses changes, indicating that the seals are "moving" relative to the registration marks, the CPU will activate motor 112 to vary the diameter of sealing drum 28, and, therefore, the positions of seal bars 30, until the number of such pulses equals the number of pulses registered by the CPU when the registration marks were in phase with the seals. In this manner, the CPU can automatically maintain the desired distance between the seals and the registration marks by adjusting the diameter of sealing drum 28.

In order to maintain a constant minimum distance between the seals and the perforations, the present invention automatically adjusts the angular position of the perforator blade 80, by changing the rate of rotation of perforator block 82, in reference to the positions of the activated seal bars 30. TO do this, the CPU registers and continues to track the number of pulses generated by encoder 136 between the signals generated in turn by the drum proximity switch 144 and the perforator proximity switch 150. The diameter of pulley 85 is selected so that, for each seal produced, there will be a corresponding perforation. Therefore, assuming the diameter of sealing drum 28 will not change, an assumption which can be made during the initial test stages of the production run, the number of pulses between signals from drum switch 144 and perforator switch 150 will be constant. During the initial test stages of the production run, the operator will observe the skirt length, i.e., the distance between the perforation and an adjacent seal. If the skirt length is too great, the operator will enter an appropriate command into console 130 and the CPU will activate synchronous motor 166 to rotate in the reverse direction to thereby slow the rate of rotation of perforator block 82 with respect to perforator drive pulley 85 and, consequently, sealing drum 28. The location of the perforation will consequently "move" closer to the seal. If the skid length is too small, the operator will enter an appropriate command into console 130 and the CPU will activate motor 166 to increase the rate of rotation of perforator block 82 with respect to perforator drive pulley 85 to consequently "move" the perforation farther from the seal. Once the perforation is in the desired position with respect to the seal, the operator will invoke another command and the CPU will signal synchronous motor 166 to stop. The CPU will simultaneously register the number of pulses generated by encoder 136 between signals generated in turn by drum switch 144 and perforator switch 150 at this point. This number corresponds to the desired skid length. The CPU will thereafter continue to track the number of pulses between signals from drum switch 144 and perforator switch 150 for each successive bag produced and compare this number to the number corresponding to the desired skid length. If the two numbers are different, the CPU will activate synchronous motor 166 to either increase or decrease the rate of rotation of block 82 until the numbers are again equal. For example, if the number of pulses between signals from drum switch 144 and perforator switch 150 is greater than the number of pulses corresponding to the desired skirt length, indicating that the actual skid length is too small, the CPU will signal motor 166 to rotate in the forward direction to thereby increase the rate of rotation of perforator block 82 with respect to perforator drive pulley 85. The number of pulses between signals from drum switch 144 and perforator switch 150 will consequently decrease as the perforation "moves" farther from the seal. Once the number of pulses equals the number of pulses corresponding to the desired skirt length, the CPU will deactivate motor 166. By continually tracking the number of pulses between drum switch 144 and perforator switch 150, comparing this number to the number of pulses corresponding to the desired skirt length, and activating synchronous motor 166 if the two numbers are different, the CPU can automatically maintain the desired minimum skirt length. Thus, once the operator invokes the appropriate information concerning the desired skirt length during the initial test stages of the production run, the CPU will maintain that skirt length for the remainder of the production run regardless of any changes in the location of the seals resulting from adjustments to sealing drum 28 to maintain the proper distance between the seals and the registration marks. As a result, the skirt length can be minimized, and the amount of material typically wasted thereby reduced, without requiring constant operator observation and adjustment of the perforator during the production run.

In another embodiment of the invention, the constant minimum distance between the seals and the perforations is maintained by automatically adjusting the angular position of the perforator blade 80 in reference to the position of the registration marks on film F. To do this, bag machine 10 is provided with a registration mark detector 200, similar to registration mark detector 140, which is located upstream of nip rolls 50 and 52 and connected with the CPU via a line 202 (FIG. 1). Registration mark detector 200 is preferably a photo scanner and will generate a signal each time a printed registration mark passes within its range. The CPU registers and continues to track the number of pulses generated by encoder 136 between the signals generated in turn by registration mark detector 200 and the perforator proximity switch 150. As described above with reference to the previous embodiment, during the initial test stages of the production run the operator will enter the appropriate commands into console 130 until the perforations are in the desired position with respect to either the seals or the registration marks. Once this is done, the CPU will register the number of pulses generated by encoder 136 between signals generated in turn by registration mark detector 200 and perforator switch 150 at this point. This number corresponds to the desired distance between the registration mark and the perforation, which in turn is an indication of the desired skirt length. The CPU will thereafter continue to track the number of pulses between signals from registration mark detector 200 and perforator switch 150 for each successive bag produced and compare this number to the number corresponding to the desired distance between the registration marks and the perforations. If the two numbers are different, the CPU will activate synchronous motor 166 to either increase or decrease the rate of rotation of block 82 until the numbers are again equal. By continually tracking the number of pulses between registration mark detector 200 and perforator switch 150, comparing this number to the number of pulses corresponding to the desired distance between the registration marks and the perforations, and activating synchronous motor 166 if the two numbers are different, the CPU can automatically maintain the desired minimum skirt length. Thus, once the operator invokes the appropriate information concerning the desired skirt length during the initial test stages of the production run, the CPU will maintain that skirt length for the remainder of the production run regardless of any changes in the location of the seals resulting from adjustments to sealing drum 28 to maintain the proper distance between the seals and the registration marks.

in yet another embodiment of the invention, registration mark detector 200 is eliminated and the outputs from registration mark detector 140 are used in conjunction with the signals from perforator switch 150 as a basis for maintaining the desired distance between the registration marks and the perforations, as described above.

Figure 5:
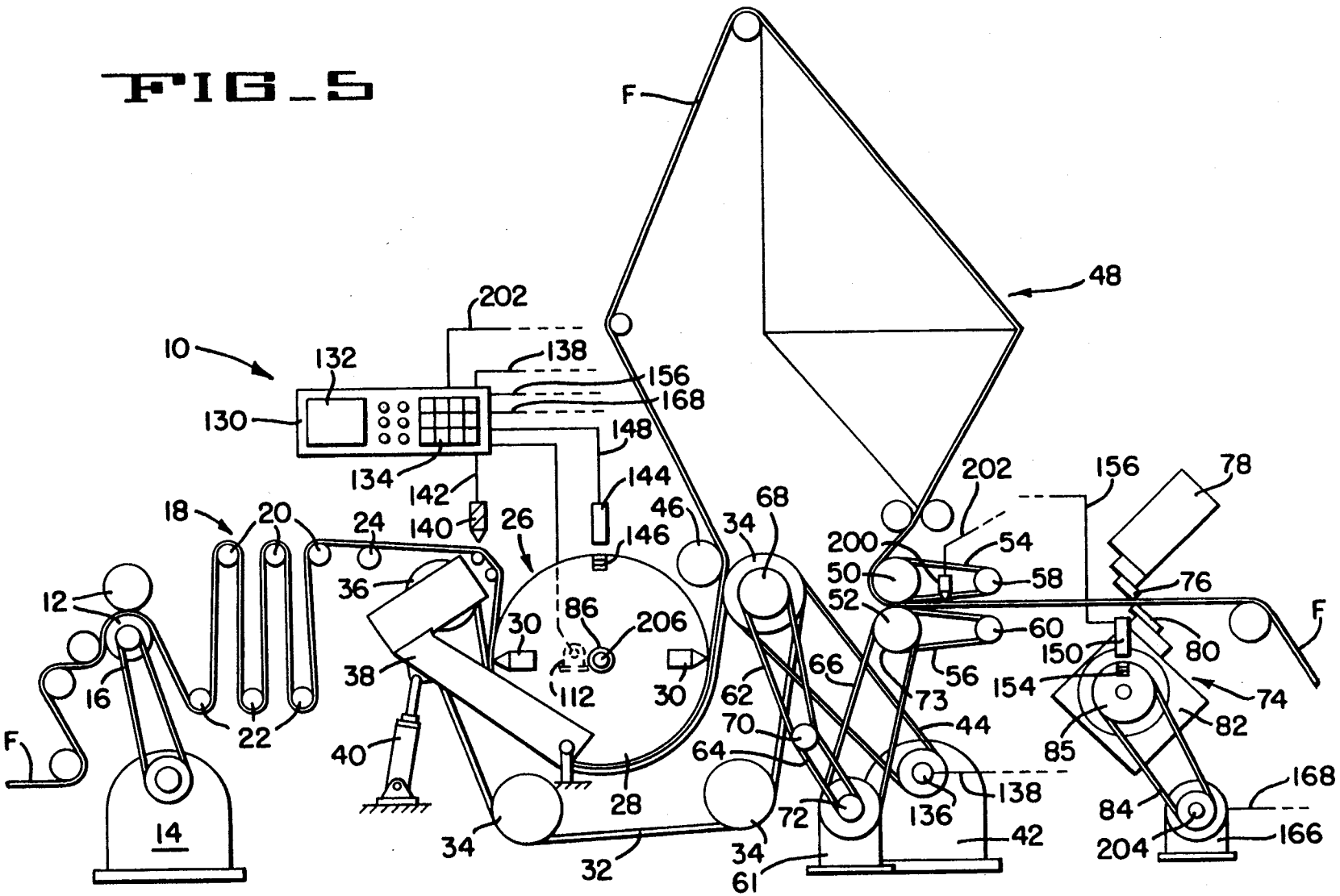
FIG. 5 is a schematic representation of a bag making machine incorporating another embodiment of the present invention.

In another embodiment of the invention, depicted in FIG. 5, lower perforator block 82 is driven through belt 84 by motor 166, which is preferably a servo motor, rather than by shaft 86 of sealing drum 28, as in the previous embodiments. In addition, differential 158, described in the previous embodiments, is eliminated. Instead, the precise positioning of perforator blade 80 is controlled directly by servo motor 166, which includes an encoder 204. An encoder 206 mounted to shaft 86 of sealing drum 28 provides the positioning pulses which the CPU uses to control the positioning of servo motor 166, in a manner known to those in the art. In addition, servo motor 166 and, therefore, perforator blade 80 are driven at a predetermined ratio to the rotation of shaft 86: 1 to 1 if only one seal bar 30 is energized, 2 to 1 if two seal bars 30 are energized, and so on.

In this embodiment, an error signal is generated during each cycle of bag machine 10, a cycle being defined as one pass of a bag through the machine, which also corresponds to one revolution of the shaft of servo motor 166 and, consequently, one revolution of perforator block 82. The CPU uses this error signal to adjust the cycle length of servo motor 166 during each cycle of bag machine 10 to ensure that each perforation is precisely positioned on film F relative to a registration mark. In this embodiment, encoder 204 functions as a positional reference signal generating means and the CPU registers the number of pulses between signals from switch 150 and registration mark detector 200. The CPU compares this number to a number of pulses, referred to as the perforation offset, related to the actual distance between switch 150 and detector 200. The perforation offset is computed by dividing the distance between switch 150 and detector 200 by the desired bag length, and then multiplying this value by the cycle length of servo motor 166, in pulses. The distance between switch 150 and detector 200 and the desired bag length are entered by the operator through keypad 134, while the cycle length of servo motor 166 is stored within the memory means of console 130 during the manufacture of bag machine 10. The error then is the difference between the perforation offset and the number of pulses between signals from switch 150 and detector 200. This error, which is in pulses, is applied to the cycle length of servo motor 166 to temporarily change the cycle length and either speed up or slow down servo motor 166 so that the difference between the perforation applied to film F and the registration mark detected by detector 200 is a predetermined fixed distance. Thus, precise positioning of perforator 74 is obtained for each cycle of bag machine 10 to ensure that the perforations for each bag are in the proper desired location. Therefore, the skirt length can be minimized and the amount of film F required to produce a bag can consequently be reduced.

If the error is too great, however, servo motor 166 cannot position perforator 74 in the proper position for the current cycle. This is because of inherent limitations in servo motor 166 and other aspects of bag machine 10. Thus, when the error is greater than a preselected maximum value, which is a number of pulses corresponding to a maximum distance determined for a given servo system, for example four centimeters, the CPU will apply the maximum value to the cycle length of servo motor 166 for the current cycle and subsequent cycles until the error is less than the maximum value.

Figure 6:
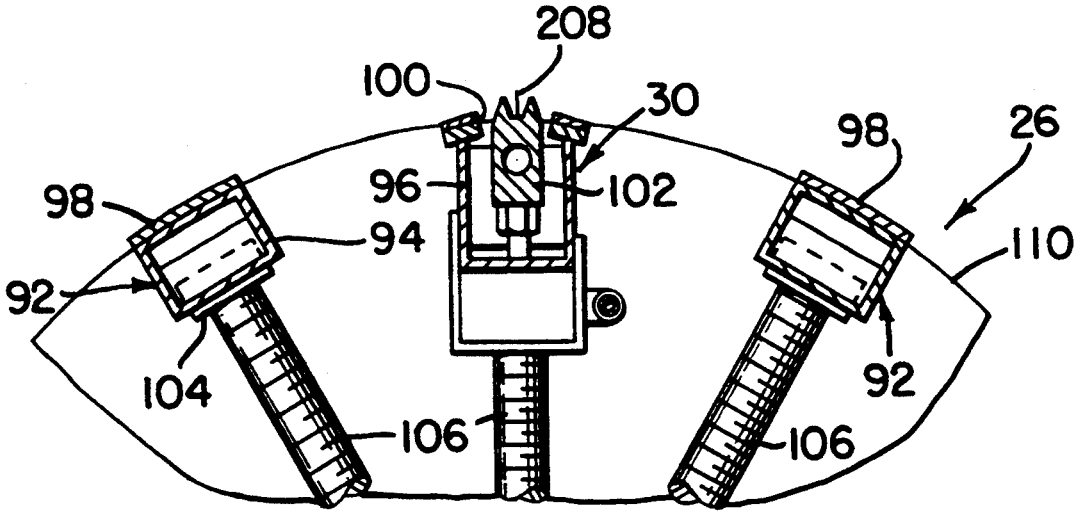
FIG. 6 is a partial cross-sectional view of an embodiment of the sealing drum depicted in FIG. 3.

In this embodiment, the registration mark detected by registration mark detector 200 is preferably applied to film F a fixed distance from and in close proximity to the seals. Referring to FIG. 6, this is accomplished by modifying seal bars 30 to apply a registration mark to film F. While the registration mark can be a print mark, in which case registration mark detector 200 would be a photo scanner, the preferred registration mark is a notch, which is formed in film F by a heated blade 208 mounted to seal bars 30 in any conventional manner. Blade 208 is preferably two centimeters in length, extends longitudinally from one end of seal bar 30, and is activated in conventional fashion to melt the notch in the edge of film F. In a twin seal application, heating element 102 comprises two seal peaks and blade 208 is mounted between the peaks, as is shown in FIG. 6.

In the preferred embodiment, the registration mark is applied to film F in the precise position where the perforation should be located. Thus, the error represents the distance between the position of perforator blade 80 and the registration mark. When the error is zero, blade 80 will strike film F on the registration mark. When the error is other than zero, the error is applied to the cycle length of servo motor 166 so that perforator blade 80 will also strike film F on the registration mark. If, during the initial runs of bag machine 10, the operator observes that the perforations are being applied a certain distance from the registration mark, the operator can input a corrected value for the distance between switch 150 and detector 200 so that the perforations will be applied directly on the registration marks. This embodiment therefore allows for precise positioning of the perforations with respect to the seals for each cycle of bag machine 10.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. In an apparatus for making plastic bags from a continuous film of material comprising a sealing drum having at least one seal bar for imparting transverse seals to the film at regularly spaced intervals and a perforator having a rotatable perforator blade for imparting transverse perforations to the film at regularly spaced intervals, the improvement comprising:

means for applying registration marks to the film at regularly spaced intervals;

means for generating a signal representative of the position of each registration mark;

means for generating a signal representative of the position of each perforation;

means for generating a positional reference signal against which each registration mark signal can be compared with each perforation signal;

means responsive to the positional reference signal generating means, the registration mark signal means and the perforation signal means for determining a positional difference between each registration mark and each perforation;

means for rotating the perforator blade, the rotating means having a predetermined cycle length;

means for computing a perforation offset value as a function of a desired bag length, the cycle length and a distance between the registration mark signal means and the perforation signal means;

means for comparing the positional difference with the perforation offset value and applying a difference therebetween to the cycle length of the rotating means to thereby maintain a desired spacing between each perforation and each registration mark.

2. The apparatus of claim 1, wherein the means for adjusting the position of the perforator blade is a servo motor.

3. The apparatus of claim 2, wherein the positional reference signal generating means comprises an encoder.

* * * * *